US005701782A

United States Patent [19]

Padula

[11] Patent Number: 5,701,782

[45] Date of Patent: Dec. 30, 1997

[54] ROTARY PRESS

[76] Inventor: Filippo D. Padula, 1420 Balsam Way, Milford, Mich. 48381

[21] Appl. No.: 764,602

[22] Filed: Dec. 11, 1996

[51] Int. Cl.[6] ..... B21J 9/19

[52] U.S. Cl. ..... 72/452.4; 72/452.9; 83/628; 100/292

[58] Field of Search ..... 72/403, 405, 452.1, 72/452.4, 452.6, 452.7, 452.9, 472; 83/618, 622, 628; 100/292, 257

[56] References Cited

U.S. PATENT DOCUMENTS

| | | | |
|---|---|---|---|
| 2,327,646 | 8/1943 | Hutchinson | 83/622 |
| 3,421,397 | 1/1969 | Clark | 83/623 |
| 3,538,735 | 11/1970 | Zimmerman | 72/452.9 |
| 3,557,599 | 1/1971 | Eickenhorst | 72/404 |
| 3,662,640 | 5/1972 | Wrona | 83/530 |
| 3,991,681 | 11/1976 | Antosiak | 100/257 |
| 4,079,668 | 3/1978 | Gailus et al. | 200/214 |
| 4,208,899 | 6/1980 | Pieper | 72/344 |
| 4,459,840 | 7/1984 | Francis | 72/452.4 |
| 4,794,224 | 12/1988 | Spektor et al. | 219/216 |
| 5,315,926 | 5/1994 | Kanamaru et alf. | 72/452.6 |

FOREIGN PATENT DOCUMENTS

| | | | |
|---|---|---|---|
| 2111988 | 11/1971 | Germany | 72/452.9 |
| 47-046147 | 11/1972 | Japan | 72/452.4 |

*Primary Examiner*—David Jones
*Attorney, Agent, or Firm*—Gifford, Krass, Groh, Sprinkle, Patmore, Anderson & Citkowski, P.C.

[57] ABSTRACT

A press as provided for stamping parts from a sheet of stock material. The press includes a frame having a fixed platen secured to the frame against movement. A movable platen is movably mounted to the frame between a closed position in which the movable platen is spaced from the fixed platen by a distance sufficient to receive the sheet of stock material between the platens, and a closed position in which the stock material is sandwiched between the platens to form the part. A drive wheel is rotatably mounted to the frame about an axis parallel to the axis of movement of the movable platen. A plurality of cam members on the drive wheel engage cam followers on the movable platen during rotation of the wheel in order to move the movable platen between its retracted and its closed position. Each cam member includes a dwell portion which retains the movable platen in its closed position for a predetermined angular rotation of the wheel.

10 Claims, 3 Drawing Sheets

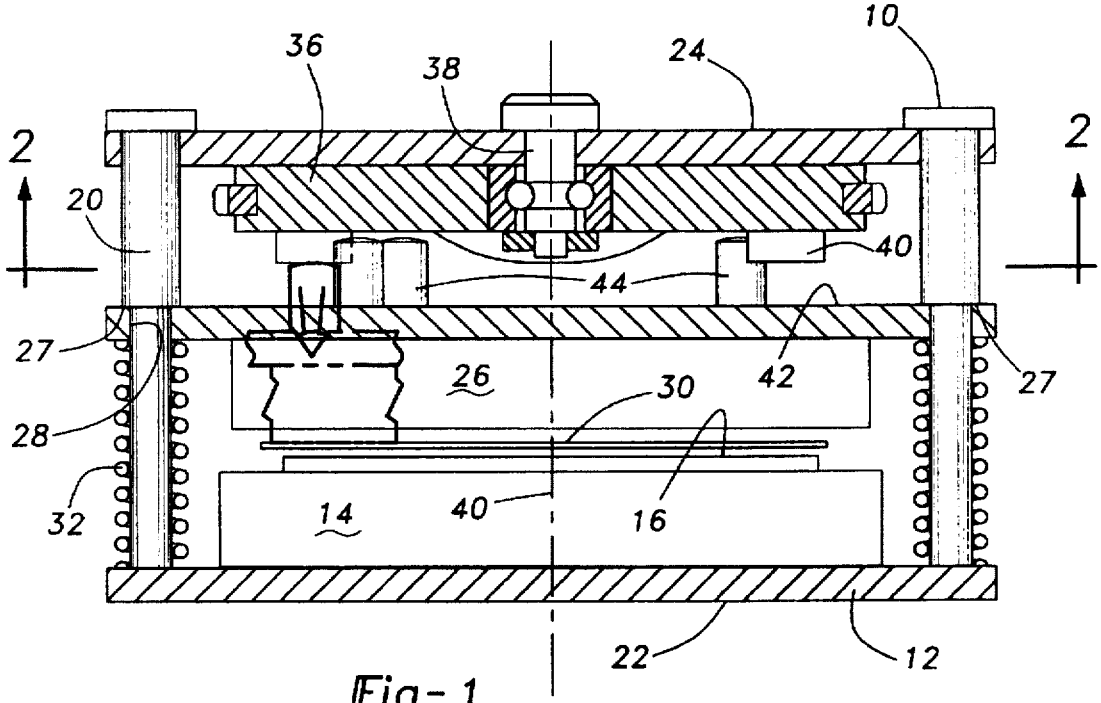
Fig-1
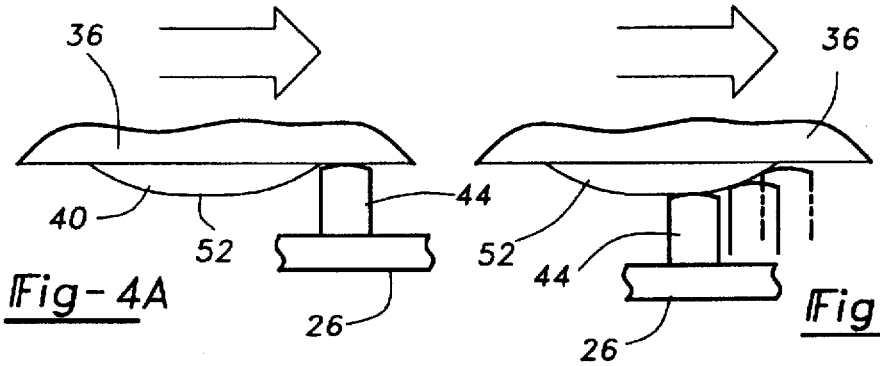
Fig-4A
Fig-4B
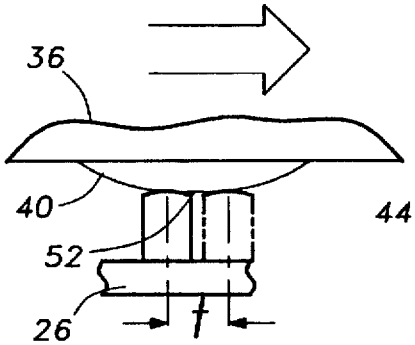
Fig-4C
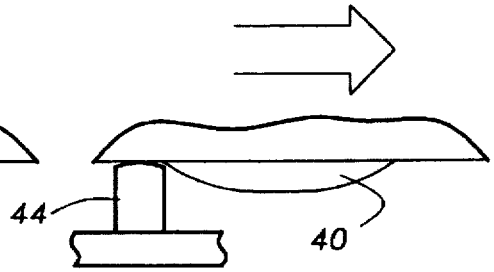
Fig-4D

ROTARY PRESS

BACKGROUND OF THE INVENTION

I. Field of the Invention

The present invention relates generally to presses and, more particularly, to a press for stamping metallic parts from a sheet of stock material.

II. Description of the Prior Art

There are many previously known presses for stamping metallic parts from sheet metal. In many of these previously known presses, the stock material is fed in between two platens which are continuously moved between a retracted position in which the stock material is positioned between two platens, and a closed position in which the platens engage the stock material to form the part. In many situations, the stock material is continuously fed through the press for the repetitious stamping of the parts.

In these previously known presses, the movable platen is continuously in the state of movement between its retracted and its closed position. As such, the movable platen continuously moves through a partially open-closed-partly open position such that the platen is in its closed position for only a brief instant of time.

One disadvantage of these previously known presses is that the amount of time that the movable platen is in its closed position is insufficient to completely relax the stock material and form the part. Rather, the formed part frequently exhibits "spring back" in which the part does not fully adopt the form defined by the press platens. Such misformed parts usually must be scrapped.

SUMMARY OF THE PRESENT INVENTION

The present invention provides a press which overcomes all of the above-mentioned disadvantages of the previously known presses.

In brief, the press of the present invention comprises a frame having a fixed platen secured against movement to the frame. A movable platen is movably mounted to the frame between a retracted position and a closed position. In this retracted position, the movable platen is spaced from the fixed platen by a distance sufficient to receive the stock material between the platens. Conversely, in its closed position, the stock material is sandwiched in between the platens thus forming the stamped part.

In order to move the movable platen between its retracted position and its closed position, a drive wheel is rotatably secured to the frame about an axis generally parallel with the axis of movement of the movable platen. This drive wheel includes a plurality of cam members which cooperate with a plurality of cam followers secured to the movable platen. Consequently, upon rotation of the drive wheel, the cam members engage the cam followers to cyclically move the movable platen between its retracted and its closed position.

Each of the cam members, furthermore, includes a dwell portion along its length. This dwell portion is designed such that the movable platen is maintained in its closed position during a predetermined angular rotation of the drive wheel. This prolonged closure of the movable platen relative to the previously known presses is sufficient to allow the stock material to relax once pressed into shape and thus minimize the amount of spring back of the formed parts.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which:

FIG. 1 is a side sectional view illustrating a preferred embodiment of the present invention;

FIGS. 4A–4D are diagrammatic views illustrating the operation of the preferred embodiment of the present invention.

DETAILED DESCRIPTION OF PREFERRED EMBODIMENTS OF THE PRESENT INVENTION

Figure 2:
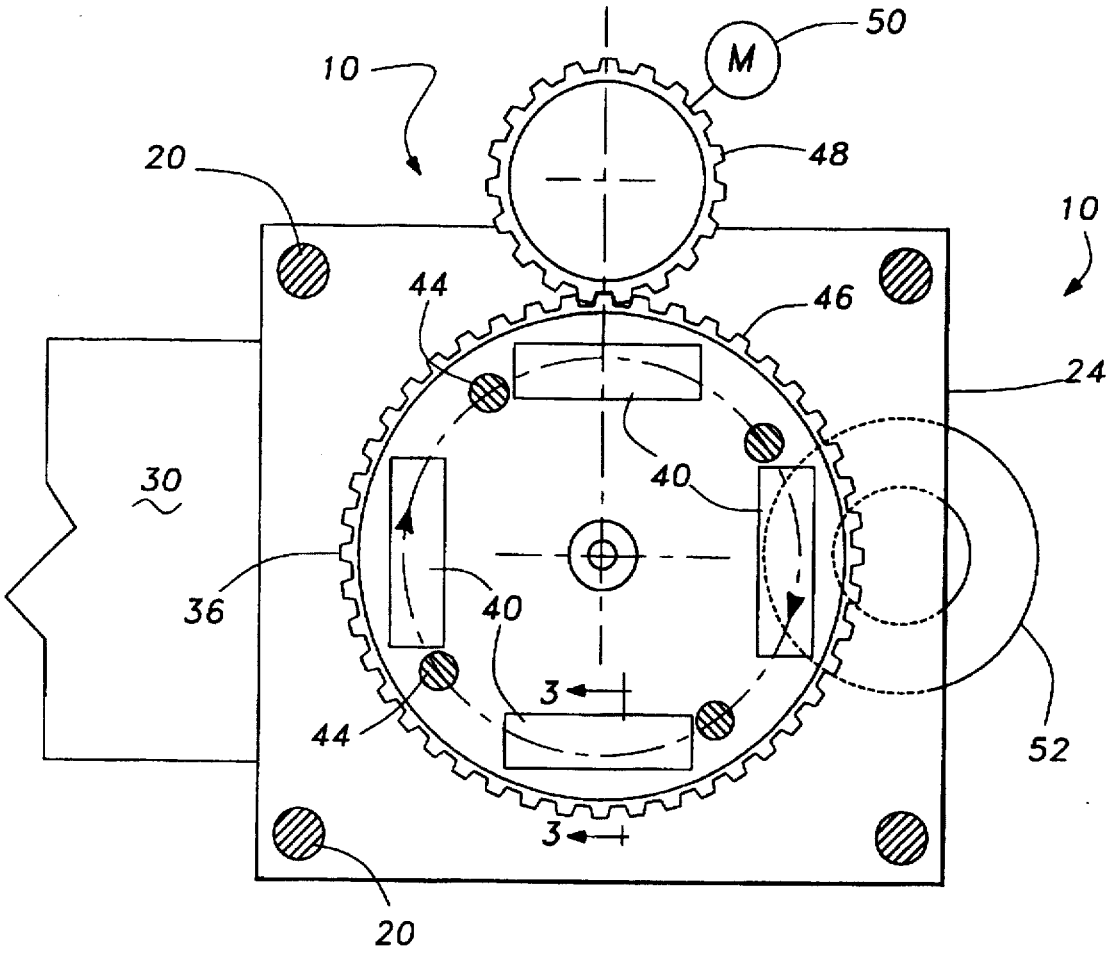
FIG. 2 is a sectional view taken substantially along line 2—2 in FIG. 1.
Figure 3:
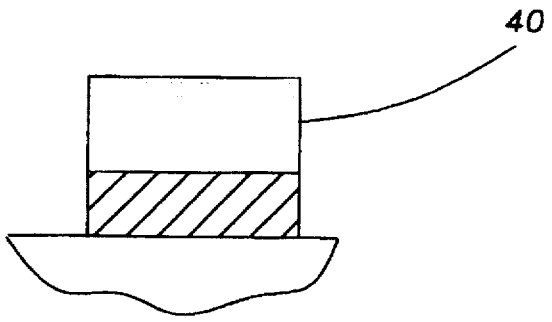
FIG. 3 is a sectional view taken substantially along line 3—3 in FIG. 2 and enlarged for clarity.

With reference first to FIGS. 1–3, a preferred embodiment of the press 10 of the present invention is there shown and comprises a rectangular frame 12 having an upper port 24 and a lower port 22. A fixed platen 14 (FIG. 1) is rigidly secured against movement to the frame 12 adjacent to lower frame part 22 and includes a face 16 which conforms to the shape of the desired finished part.

An elongated guide post 20 is secured to each comer of the frame 12 so that the longitudinal axes of the guide post 20 are parallel to each other. One end of each guide post 20 is secured to the lower frame part 22 while the other ends of the guide posts 20 are secured to the upper frame part 24.

A generally rectangular movable platen 26 includes a plurality of guide openings 28 through which the guide posts 20 extend. The movable platen 26 is thus movable along a direction parallel to the axes of the guide post 20 between a retracted position, illustrated in solid line in FIG. 1, and a closed position, illustrated in phantom line in FIG. 1. An annular abutment surface 27 on each guide post 20 limits the movement of the movable platen 26 in its retracted position.

With reference now particularly to FIG. 1, in its retracted position, the movable platen 26 is spaced from the fixed platen 14 by a distance sufficient to receive a sheet of stock material 30 therebetween. Any conventional means (not shown) can be used to convey the stock material 30 between the platens 26 and 14 in synchronism with the movement of the movable platen 26.

Conversely, when the movable platen 26 is in its closed position, the platens 14 and 26 sandwich the stock material 30 therebetween to form the part in accordance with the shape of the facing faces of the platens 14 and 26.

Any conventional means may be used to urge the movable platen 26 towards its retracted position. As shown in FIG. 1, however, a compression spring 32 in a state of compression is disposed around each post 20 in between the bottom frame member 22 and the movable platen 26. Other means, however, such as pneumatic or hydraulic shock absorbers, may alternatively be used.

With reference again to FIGS. 1–3, in order to move the movable platen 26 between its retracted position and its closed position, a drive wheel 36 is rotatably mounted to the frame upper part 24 by a bearing assembly 38. The bearing assembly 38, furthermore, is arranged such that its axis of rotation 40 (FIG. 1) is parallel to the axis of the guide post 20 and thus parallel to the axis of movement of the movable platen 26.

A plurality of circumferentially spaced cam members 40 are secured to the drive wheel 36 such that the cam members 40 face the side 42 (FIG. 1) of the movable platen 26 opposite from the fixed platen 14. A plurality of cam followers 44 are then secured to and extend upwardly from the side 42 of the movable platen 26. Furthermore, as best shown in FIG. 2, the cam followers 44 are arranged on the drive wheel 36 such that, upon rotation of the drive wheel 36, the cam members 40 cyclically engage the cam followers 44 in unison with each other.

As best shown in FIG. 2, preferably four cam followers 44 are provided on the movable platen 26 and, likewise, four cam members 40 are attached to the drive wheel 36. The use of four or more cam members 40 with their associated cam followers 44 minimizes any cocking of the movable platen 26 which might otherwise occur with fewer cam members 40. It will be understood, however, that more or fewer cam members 40 and cam followers 44 may be utilized without deviation from the spirit or scope of the invention.

With reference now to FIG. 2, any conventional means may be utilized to drive the drive wheel 36. However, as shown, a gear ring 46 is secured to the drive wheel 36 which meshes with a drive pinion 48. The drive pinion 48 is rotatably driven by a motor 50 (illustrated only diagrammatically).

With reference now particularly to FIG. 4A–4D, each cam member 40 includes a dwell portion 52 which extends for a predetermined angular amount t (FIG. 4C) of the cam 40. As described more fully below, this dwell portion 52, which may comprise a flat in the cam 40, maintains the movable platen 26 in its closed position for a period corresponding to the angular rotation t of the drive wheel 36.

Still referring to FIGS. 4A–4D, in FIG. 4A the movable platen 26 is illustrated in its retracted position in which the cam follower 44 is out of engagement with the cam member 40. In this position, the stock material 30 (FIG. 1) is conveyed between the platens 26 and 14 in the previously described fashion.

Continued rotation of the drive wheel 36, and thus of the cam members 40, causes the cam members 40 to engage the cam followers 44 as shown in FIG. 4B. In doing so, the cam members 40 drive the movable platen 26 to its closed position thus forming the part from the stock material 30.

With reference now to FIG. 4C, as the drive wheel 36 continues to rotate, the cam member 40 engages the cam follower 44 and maintains the movable platen 26 in its closed position for a predetermined angular rotation of the drive wheel 36 illustrated at t. It will be understood, however, that the time lapse that the movable platen 26 is maintained in its closed position will vary depending not only upon the length of the dwell portion 52 but also the speed of rotation of the drive wheel 36.

Lastly, in FIG. 4D, the cam member 40 is movable out of engagement with the cam follower 44. In doing so, the springs 32 (FIG. 1) move the movable platen 26 to its retracted position against the abutment surface 27 which enables not only the completed part 56 (FIG. 2) to be removed from the press, but to also to feed a new section of stock material 30 in between the platens 14 and 26.

Figure 5:
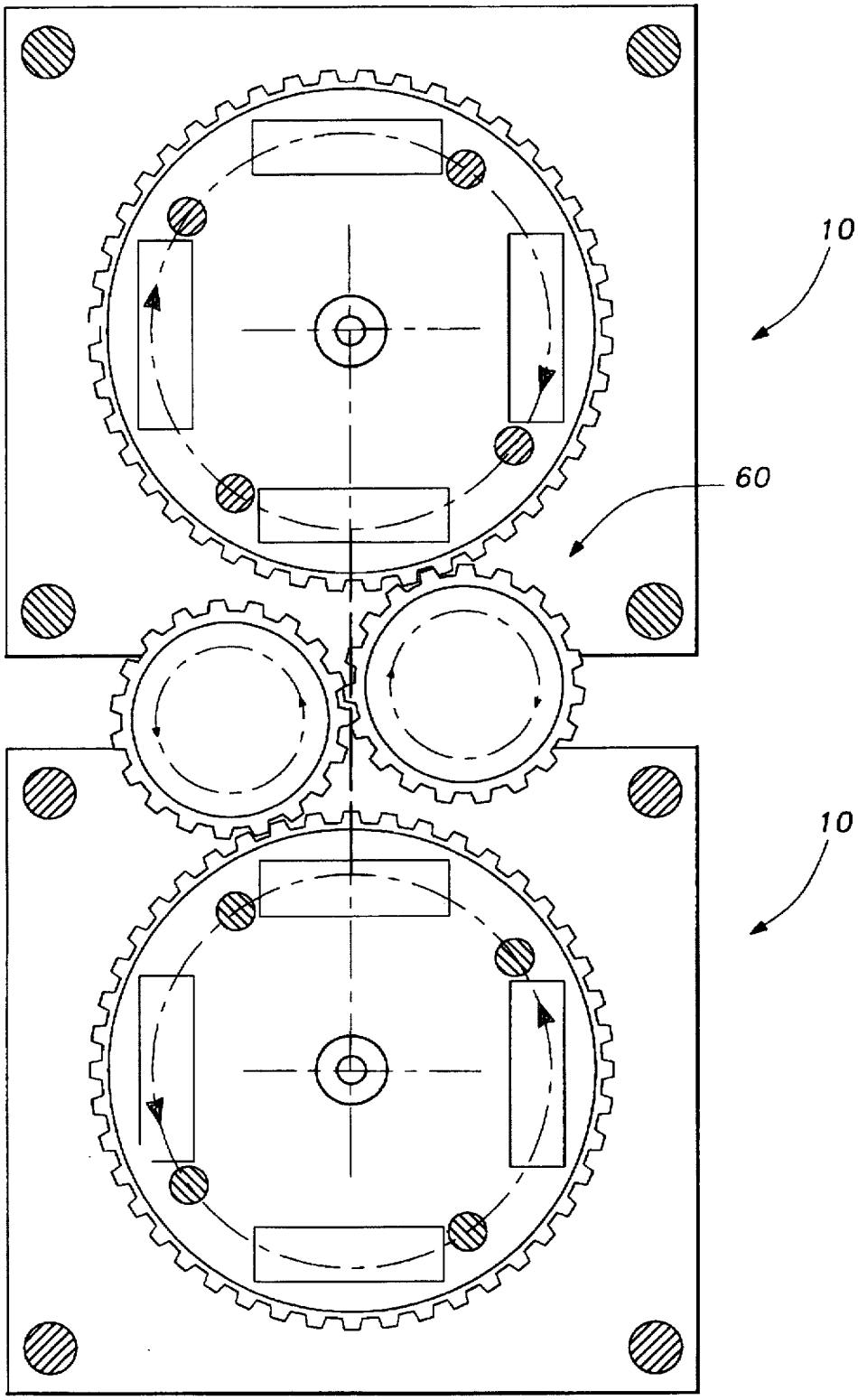
FIG. 5 is a top view illustrating a further preferred embodiment of the present invention.

With reference now to FIG. 5, since the cam members 40 are radially offset from the center of rotation of the drive wheel 36, a rotational torque is necessarily imposed upon the drive wheel 36 caused by the coaction between the cams 40 and cam followers 44. In order to minimize or cancel the rotational torque, preferably two presses 10 are operated in tandem with each other. A gearing arrangement 60 is provided between the presses 10 such that the drive wheels 36 are rotatably driven in the opposite rotational direction from each other. Thus, when the drive wheels 36 are driven in synchronism with each other such that the cams 40 on the drive wheels 36 synchronously engage their respective cam followers 44, the rotational torque imposed on one drive wheel is offset by the opposite rotational torque imposed on the other drive wheel.

From the foregoing, it can be seen that the present invention provides a rotary press which overcomes the previously known disadvantages of such presses.

Having described my invention, however, many modifications thereto will become apparent to those skilled in the art to which it pertains without deviation from the spirit of the invention as defined by the scope of the appended claims.

I claim:

1. A press for stamping parts from a sheet of stock material comprising:

a frame, a fixed platen secured against movement to said frame, a movable platen, means for movably mounting said movable platen to said frame so that said movable platen is movable between a retracted position in which said movable platen is spaced from said fixed platen by a distance sufficient to receive the sheet of stock material between said platens, and a closed position in which the stock material is sandwiched between said platens to form the part, means for moving said movable platen between said retracted position and said closed position comprising a plurality of cam followers secured to said movable platen on a side opposite from said movable platen, a drive wheel rotatably secured to said frame about an axis parallel to an axis of movement of said movable platen adjacent said side of said movable platen, a plurality of cams secured to said drive wheel at a position such that said cams engage said cam followers upon rotation of said drive wheel, and means for rotatably driving said drive wheel.

2. The invention as defined in claim 1 wherein each cam includes a dwell portion so that said movable platen remains in said closed position during a preset angular rotation of said drive wheel.

3. The invention as defined in claim 2 wherein said dwell portion comprises a flat formed on said cam members.

4. The invention as defined in claim 3 wherein said plurality of cam members comprises four cam members.

5. The invention as defined in claim 1 wherein said mounting means comprises a plurality of elongated spaced guide posts secured to said frame so that an axis of each post is parallel to the axis of movement of said movable platen, said guide posts extending through registering openings in said movable platen.

6. The invention as defined in claim 5 and comprising means for urging said movable platen toward said retracted position.

7. The invention as defined in claim 6 wherein said urging means comprises a compression spring disposed around each guide post.

8. The invention as defined in claim 5 wherein said guides each include an abutment surface which abuts against said movable platen in said retracted position.

9. The invention as defined in claim 1 and comprising means for canceling rotational torque on said drive wheel.

10. The invention as defined in claim 9 wherein said canceling means comprises a second press substantially identical to said first mentioned press, and means for mechanically connecting said drive wheels of said presses together so that said drive wheels are synchronously driven in opposite rotational directions.

* * * * *

UNITED STATES PATENT AND TRADEMARK OFFICE

CERTIFICATE OF CORRECTION

PATENT NO. : 5,701,782
DATED : December 30, 1997
INVENTOR(S) : Filippo D. Padula It is certified that error appears in the above-identified patent and that said Letters Patent is hereby corrected as shown below:

Column 4, Claim 1,
Line 28, delete "movable" and insert --fixed--.

Signed and Sealed this

Third Day of July, 2001

Nicholas P. Godici

*Attest:*

*Attesting Officer*

NICHOLAS P. GODICI
*Acting Director of the United States Patent and Trademark Office*